US005095726A

United States Patent [19]

Mackall et al.

[11] Patent Number: 5,095,726

[45] Date of Patent: Mar. 17, 1992

[54] DEDIMPLER AND DEBURRING APPARATUS

[75] Inventors: Allen E. Mackall; Richard L. Shafer, both of Negley, Ohio

[73] Assignee: Buckeye Manufacturing Company, East Palestine, Ohio

[21] Appl. No.: 648,736

[22] Filed: Jan. 31, 1991

Related U.S. Application Data

[63] Continuation-in-part of Ser. No. 514,662, Apr. 25, 1990.

[51] Int. Cl.[5] ..... B21D 15/00

[52] U.S. Cl. ..... 72/40; 72/111; 72/419

[58] Field of Search ..... 72/40, 110, 111, 419, 72/424, 428; 29/33 A, 33 J, 33 P, 81.12, 81.05; 51/331; 408/39, 44; 409/247, 248

[56] References Cited

U.S. PATENT DOCUMENTS

| | | | |
|---|---|---|---|
| 863,841 | 8/1907 | George . | |
| 1,194,038 | 8/1916 | Krummel | 72/191 |
| 2,941,567 | 6/1960 | Simborg . | |
| 2,966,193 | 12/1960 | Fischer | 72/111 |
| 3,183,533 | 5/1965 | Kull | 72/419 |
| 3,357,396 | 12/1967 | Melind | 408/44 |
| 3,554,363 | 1/1971 | Elineau . | |
| 3,624,965 | 12/1971 | Gepfert | 51/138 |
| 4,608,846 | 9/1986 | Rathbun | 72/111 |

FOREIGN PATENT DOCUMENTS

| | | | |
|---|---|---|---|
| 0437547 | 7/1974 | U.S.S.R. | 72/419 |
| 0770608 | 9/1980 | U.S.S.R. | 72/424 |
| 0863206 | 9/1981 | U.S.S.R. | 72/428 |
| 2185922 | 8/1987 | United Kingdom | 72/428 |

OTHER PUBLICATIONS

"Rasamat 1001", Foremost Machinery Corp., Northbrook, IL, 1989.

"Are You Still Deburring Tubes The Hard Way?", Accurate Equipment Co., Cincinnati, OH.

"Model 912A Endfinishing Machine", Haven Manufacturing Corporation, Brunswick, GA.

"Model 370 'American Pro' Finishing & Deburring Machines", Abrasive Engineering & Manufacturing, Olathe, KS, 1988.

"Burrmaster", John Marshall Engineers Ltd., West Midlands, England.

"Modern Brush Deburring", *the Fabricator,* Jul./Aug. 1989.

*Primary Examiner*—Lowell A. Larson
*Assistant Examiner*—Michael J. McKeon
*Attorney, Agent, or Firm*—Wood, Herron & Evans

[57] ABSTRACT

A combination dedimpler and deburring apparatus is provided in which tubes are serially introduced into a dedimpler machine which removes constrictions or dimples from the tube wall at the cut ends thereof to form cylindrically true ends, and then the tubes are automatically transferred to a deburring machine for the removal of burrs from such cut ends. In the dedimpler machine, the tubes are advanced to a dedimpler station where a pair of dedimpler plugs are moved by a cam arrangement into opposite ends of the tube in a precisely timed, synchronized motion to force the tube wall against cooperating press rollers and thus remove constrictions or dimples from the tube ends. The dedimpled tubes are then automatically conveyed to the deburring machine having laterally spaced brush heads which carry deburring brushes operative to remove burrs from the tube ends. The deburring apparatus includes structure for easily and accurately adjusting to tubes of different diameter and/or different length, and for adjusting the position of the deburring brushes relative to the tubes as such brushes become worn during operation.

20 Claims, 6 Drawing Sheets

DEDIMPLER AND DEBURRING APPARATUS

RELATED CASES

This is a Continuation-In-Part application of U.S. patent Application Ser. No. 07/514,662, filed Apr. 25, 1990, entitled "Dedimpler and Deburring Apparatus", which is owned by the same assignee as this invention.

FIELD OF THE INVENTION

This invention relates to tube handling equipment, and, more particularly, to apparatus for removing dimples and burrs from the cut ends of tubes.

BACKGROUND OF THE INVENTION

Modern production lines for the manufacture of metal tubing are capable of forming the tubing in essentially continuous lengths. In order to package and transport such tubing, auxiliary cut-off equipment is employed to sever the tubing into standard and/or customized lengths. While improvements have been made in tube cut-off equipment, such equipment nevertheless often produces a constriction or "dimple" in the tube wall adjacent the cut ends, and, in some cases, "burrs" or sharp protruding sections of metal at the cut end. These defects are particularly noticeable in lighter gauge metal tubes which are often used in applications where dimples or burrs are wholly unacceptable such as in the manufacture of childrens' toys, lawn furniture, etc.

Apparatus have been developed for automatically removing dimples from the tube wall at the cut ends of tubes. One type of commercially available dedimpler apparatus includes a pair of conical-shaped dedimpler plugs or tools, one of which is positioned on each side of a tube conveying device. A tube is moved by the tube conveying device to a dedimpler station where the two conical dedimpler plugs are axially moved toward one another, into the opposed open ends of the tube, and then rotated relative to the tube end to restore the tube to a cylindrically true condition. Preferably, a pressure roller is radially aligned with each of the conical dedimpler plugs and positioned in contact with the outer surface of the tube ends in order to provide support for the tube wall against the dedimpler plugs and prevent flaring of the cut ends.

Dedimpler apparatus of the type described above must be operated so that the opposed dedimpler plugs are axially moved toward and away from the tube ends in timed sequence with one another, and with the movement of the tubes to and from the dedimpler station. Pneumatic or hydraulic cylinders have been used in the past to effect axial movement of the dedimpler plugs, and typically a separate set of cylinders is provided for each dedimpler plug on opposite ends of the tube. Particularly at higher operating speeds, e.g., in excess of about 80 tubes per minute, it has been found to be difficult to precisely synchronize the axial movement of the two dedimpler plugs with one another, and with the movement of the tubes to and from the dedimpler station, using pneumatic or hydraulic cylinders. This limits the speed at which such dedimpler apparatus can be operated without damaging the tubes.

In addition to the dedimpling operation, many tubes require burrs to be removed from their cut ends before such tubes can be used in the manufacture of a product. Automatic deburring devices have been employed for this purpose which generally comprise a pair of brush heads laterally spaced from one another on either side of a tube transfer conveyor. The tube transfer conveyor is effective to simultaneously move a number of tubes atop a side rail carried by each brush head such that the cut ends of each tube move past a deburring brush carried by each brush head.

Deburring apparatus of the type described above must be adjustable to accommodate tubes of different diameter and length. For example, it is necessary to adjust the vertical position of the side rails with respect to the deburring brushes for tubes of varying diameter such that the cut ends of each tube are presented at the proper position relative to the deburring brushes. Adjustment of the vertical position of the side rails in many types of deburring apparatus is time-consuming, and it is difficult to ensure that the side rail on one of the brush heads has been adjusted to the same vertical position as the side rail on the other brush head.

Adjustment of deburring apparatus for tubes of different length has also presented difficulties in the past. The cut ends of the tube must be accurately located with respect to the deburring brushes in each brush head so that such brushes are located close enough to the tube ends to effectively remove burrs therefrom, but not so close as to damage the brushes or tubes. In order to obtain such length adjustment, at least one of the brush heads is movable laterally toward and away from the other brush head which varies the lateral space or width of the tube transfer conveyor therebetween. This tube length adjustment is time-consuming in many deburring apparatus, and may be performed with less than the desired accuracy.

Another problem with many prior art deburring apparatus is an inability to account for wear of the deburring brushes. After a period of use, deburring brushes become worn to some extent and their lateral position relative to the cut ends of the tube must be adjusted to maintain sufficient contact with the tubes to remove burrs. Such lateral adjustment of the deburring brushes, if permitted at all, is a time-consuming operation and it is difficult to adjust the position of the deburring brush in one of the brush heads to the same position as the deburring brush in the other brush head.

In addition to the set-up problems and limited operational speeds described above, it has been found that an inordinate amount of manual intervention is required to complete the dedimpling and deburring of tubing. Dedimpler and deburring apparatus are typically stand-alone units, and often require manual loading of tubes. After a group of tubes are manually loaded and re-sized by a dedimpling apparatus, for example, such tubes must then be retrieved, transported to a stand-alone deburring apparatus, manually fed to such deburring apparatus and then retrieved again after the deburring operation is completed. The multiple, manual operations required to perform both the dedimpling and deburring operations increase costs and reduce productivity.

SUMMARY OF THE INVENTION

It is therefore among the objectives of this invention to provide an apparatus which is operative to perform the dedimpling and deburring operations automatically without manual intervention, which runs at relatively high speeds without damaging the tubes, which permits rapid and accurate adjustment of the position of the deburring brushes and which permits rapid and accurate adjustments to accommodate tubes of different diameter and different length.

These objectives are accomplished in a combination dedimpler and deburring apparatus in which tubes of a given length are first introduced into a dedimpler machine which removes constrictions or dimples from their cut ends to form cylindrically true ends on the tubes, and then the tubes are automatically transferred to a deburring machine for the removal of burrs from such cut ends. In the dedimpler machine, the tubes are serially moved to a dedimpler station where a pair of dedimpler plugs enter opposite ends of the tube in a precisely timed, synchronized motion to force the tube wall against cooperating press rollers and thus remove constrictions or dimples from the tube wall at the ends of the tube. The dedimpled tubes are then automatically conveyed to the deburring machine having laterally spaced brush heads which carry deburring brushes operative to engage and remove burrs from the tube ends. The deburring machine includes structure for easily and accurately adjusting to tubes of different diameter and/or different length, and for adjusting the position of the deburring brushes relative to the tubes as such brushes become worn during operation of the deburring machine.

One aspect of this invention is predicated upon the concept of providing a combined dedimpling and deburring apparatus in which the dimples at the cut ends of tubes are first removed in a dedimpling machine, and then the tubes are conveyed, without manual intervention, directly to a deburring machine which removes burrs from the tube ends. Movement of the tubes through the dedimpler machine and deburring machine is controlled by a single, integrated drive train which ensures that the dedimpling and deburring operations, as well as the transfer of the tubes between the two machines, are accurately synchronized. As a result, the time required to perform both the dedimpling and deburring operations with the system herein is appreciably less than using stand-alone dedimpling and deburring units.

The dedimpler machine comprises a pair of spaced dedimpler heads, at least one of which is laterally movable with respect to the other. In one presently preferred embodiment, each dedimpler head carries half of a tube transfer mechanism which is operative to transfer tubes from a pick-up station to a dedimpler station between the heads. In an alternative embodiment, the tubes are conveyed by a ramp directly to the dedimpler station and then transferred by a rotary index wheel from the dedimpler station to the pick-up station. A pair of dedimpler plugs having conical-shaped ends, one of which is carried by each dedimpler head, are located at the dedimpler station immediately above a press roller. When a tube is moved to the dedimpler station, by either of the tube transfer mechanisms, each dedimpler plug is extended to enter one end of the tube. The dedimpler plugs are rotated within the tube so that the wall of the tube at its cut ends is forced against the press rollers to "flatten out" or remove any constrictions or dimples therein and form a cylindrically true tube end. The dedimpler plugs are then retracted from the interior of the tube which is then removed from the dedimpler station and replaced by another tube for dedimpling.

An important aspect of this invention is the provision of structure for precisely synchronizing the movement of the opposed dedimpler plugs. In order to achieve high operating speeds, both of the dedimpler plugs must be moved between the extended, dedimpling position and a retracted position at the same time, and in timed sequence with the placement of tubes at the dedimpler station. In one presently preferred embodiment, a cam and cam follower are carried within each dedimpler head which interconnect the dedimpler plug and a drive shaft associated with the tube transfer mechanism of the dedimpler machine. Each dedimpler plug is carried by a shaft which mounts the cam follower. The cam follower is movable within a groove formed in the cam carried by one of the drive shafts of the tube transfer mechanism. In response to rotation of the drive shaft and cam, the cam follower forces the dedimpler plug to move between the extended and retracted positions. Such movement of the dedimpler plug is precisely timed with the placement of tubes at the dedimpler station because of the connection between the cam follower associated with the dedimpler plug and the cam mounted to one of the drive shafts of the tube transfer mechanism to ensure that the dedimpler plugs are extended after a tube is placed at the dedimpler station and retracted before such tube is removed from the dedimpler station. The movement of the dedimpler plugs by such cam arrangement is also faster than that which can be achieved using the pneumatic or hydraulic actuators employed in other dedimpling apparatus.

In an alternative embodiment, the tubes are serially conveyed by gravity along a feed ramp to the dedimpler station. The same cam-cam follower arrangement is employed in this embodiment as in the embodiment described above, except that the drive shaft which carries the cam follower is drivingly connected to a rotary index wheel having a dog. In response to rotation of the drive shaft, the dedimpler plug is reciprocated as described above and the rotary index tube is simultaneously rotated in timed sequence to remove tubes from the dedimpler station after the dedimpler plug moves from the extended position to the retracted position.

Additionally, as explained in detail below, the drive shaft(s) for the tube transfer mechanism carried by each dedimpler head are each drivingly connected to the same, main drive shaft associated with the deburring machine of the apparatus herein to ensure that the drive shafts in each dedimpler head are rotated at the same speed. As a result, the dedimpler plug within the dedimpler head on one end of the tube is moved between the extended and retracted positions in accurately timed sequence with the movement of the dedimpler plug carried by the dedimpler head on the other end of the tube.

After being removed from the dedimpler station by the tube transfer mechanism, each tube is automatically picked up and advanced by a tube conveyor through the deburring machine portion of the apparatus herein. The deburring machine comprises a pair of spaced brush heads, at least one of which is laterally movable with respect to the other. Each of the brush heads carries a deburring brush which is located with respect to the tube conveyor so that the cut ends of the tube contact the deburring brushes and remove any burrs therefrom as the tubes move therepast.

The improvements provided by the deburring machine portion of this invention are directed to structure for making various adjustments to accommodate tubes of different diameter and length, and to account for brush wear. In one presently preferred embodiment, the tube conveyor includes a side rail carried by each brush head. These side rails support opposite ends of the tubes as they are conveyed between the brush heads. Adjustment structure is provided to quickly and accurately vary the vertical position of each side rail to ensure that both cut ends of tubes of a given diameter are presented at the appropriate position with respect to the deburring brushes in each brush head. This adjustment structure includes a scale so that the operator can easily ascertain the vertical position of the side rails, and whether the side rail of one brush head has been adjusted to the same vertical position as the side rail of the other brush head.

A second adjustment feature is provided to accommodate tubes of different length. Each brush head carries a V-shaped holder which is adapted to receive one end of a tube of given length. In order to adjust the lateral spacing of brush heads, one end of the tube is inserted into the holder on the fixed brush head, and then the lateral position of the movable brush head is adjusted until the opposite end of the tube can be placed into the holder carried by the movable brush head. With the tube snugly positioned within the holders of each brush head, the appropriate lateral space between the brush heads for that tube length is automatically obtained.

Still further adjustment structure is provided in the brush heads of this invention to accommodate wear of the deburring brushes during operation of the system. In the presently preferred embodiment, the deburring brush of each brush head is carried by a shaft rotatably received within take-up bearings. The take-up bearings at each end of the shaft are movable within ways, and adjustment structure including a scale is provided to move each take-up bearing along the ways so that the shaft and deburring brushes are moved toward and away from the tube conveyor between the brush heads. This permits adjustment of the position of each deburring brush with respect to a cut end of the tubes to ensure that sufficient contact is made between the deburring brushes and tubes to remove burrs as the brushes become worn during use.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
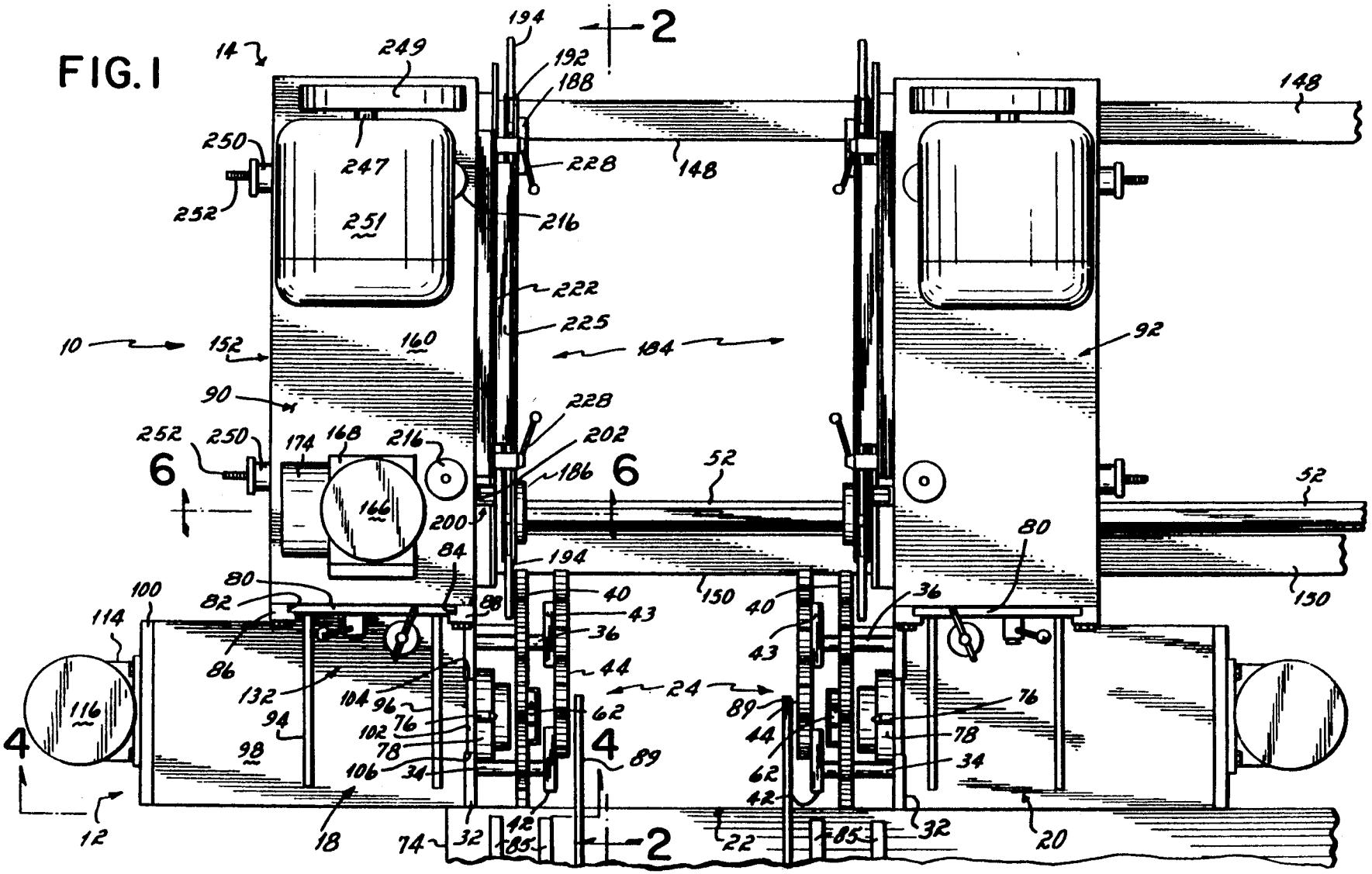
FIG. 1 is a plan view of the combined dedimpling and deburring apparatus of this invention.

The dedimpling and deburring apparatus 10 of this invention comprises a dedimpler machine 12 and a deburring machine 14 operatively connected to one another to sequentially dedimple and then deburr the cut ends of tubes 16 which are automatically fed therethrough. The dedimpler machine 12 and deburring machine 14 are described separately below.

Dedimpler Machine

Referring now to FIGS. 1–5, one embodiment of the dedimpler machine 12 comprises a fixed dedimpler head 18, a laterally movable dedimpler head 20 and a tube transfer mechanism 22 located between the dedimpler heads 18, 20. The tube transfer mechanism 22 is operative to advance individual tubes 16, one after the other, to a dedimpler station 24 between the dedimpler heads 18, 20 where constrictions or dimples formed in the tube wall at the cut ends of the tubes 16 are removed. For ease of illustration, the details of the fixed dedimpler head 18 are shown in the Figs., it being understood that the structure and operation of the movable dedimpler head 20 is identical and the following description applies to both dedimpler heads 18, 20.

Figure 4:
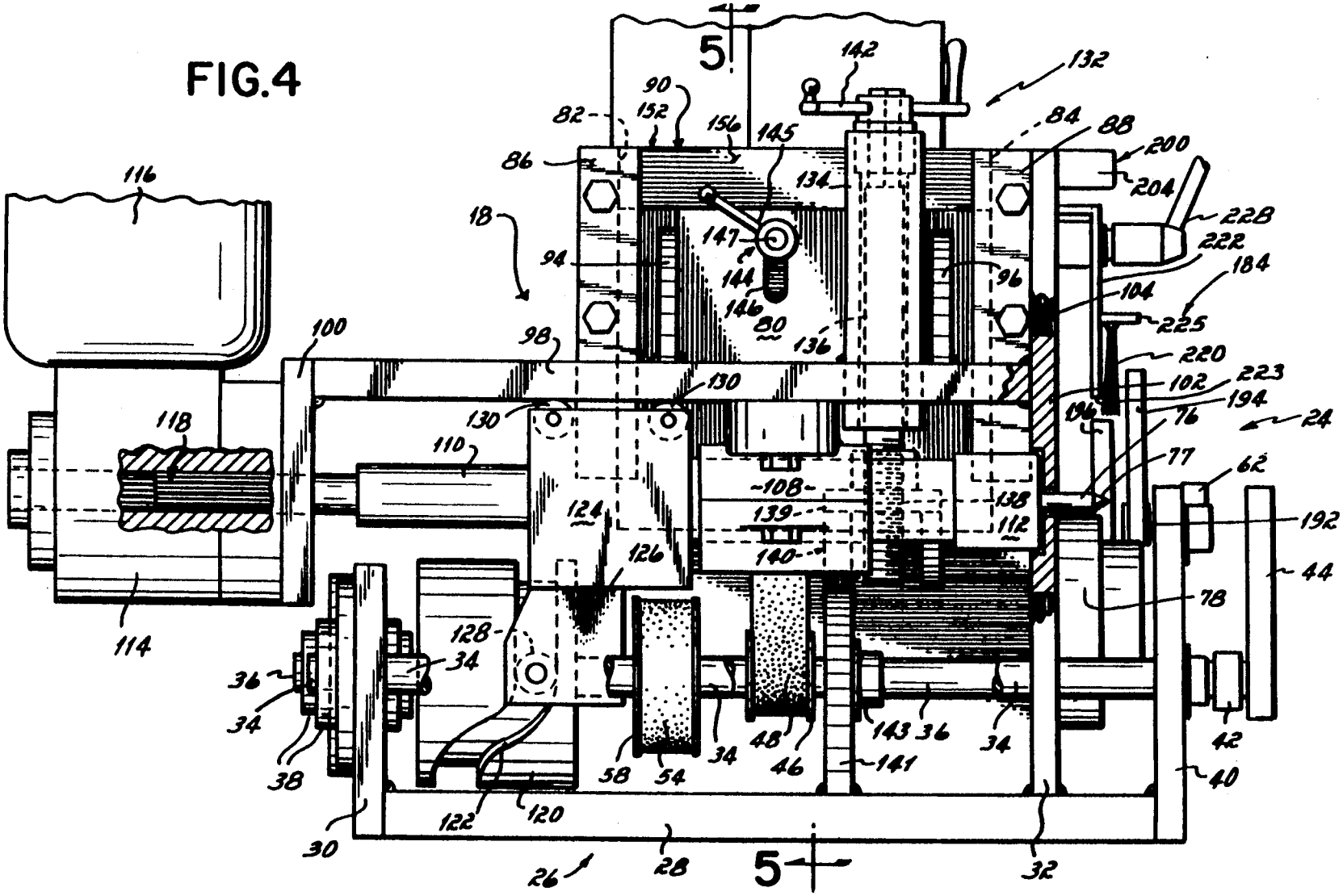
FIG. 4 is an elevational view taken generally along line 4—4 of FIG. 1.
Figure 5:
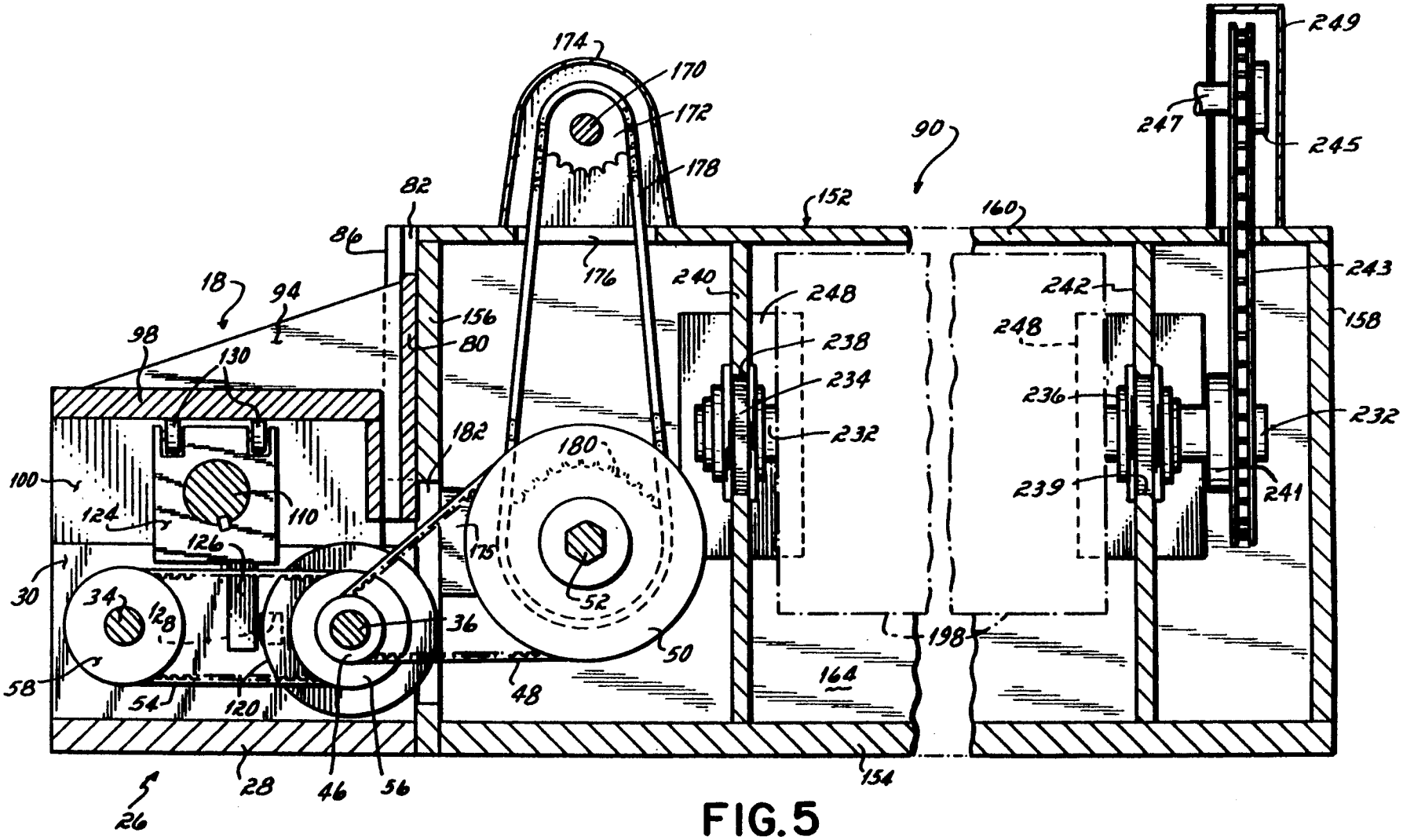
FIG. 5 is a cross sectional view taken generally along line 5—5 of FIG. 4.

As best shown in FIGS. 4 and 5, the dedimpler head 18 comprises a yoke-shaped base 26 including a base plate 28, a relatively short, vertical side plate 30 and an elongated vertical side plate 32. These side plates 30, 32 rotatably mount a pair of spaced, walking beam drive shafts 34 and 36 which are each mounted at one end in a bearing 38 carried by the side plate 30. The opposite ends of the drive shafts 34, 36 extend through the side plate 32 to a fixed walking beam 40 connected to base plate 28 which forms a part of the tube transfer mechanism 22 as described below. Such ends of drive shafts 34, 36 are rotatably mounted to lever arms 42, 43, respectively, connected to a movable walking beam 44, which forms the other part of tube transfer mechanism 22.

The drive shaft 36 mounts a timing pulley 46 which is connected by a timing belt 48 to a timing pulley 50 mounted to a hex-shaped, main drive shaft 52 of the deburring machine 14. As described in detail below, this main drive shaft 52 is the primary drive means for the entire apparatus 10 and ensures that the dedimpling and deburring operations are precisely controlled and synchronized relative to one another. Rotation of the drive shaft 36 caused by the timing belt 48 and main drive shaft 52 is directly transmitted to the other walking beam drive shaft 34 by a timing belt 54 connected between a first timing pulley 56 mounted on the drive shaft 36 and a second timing pulley 58 carried on the drive shaft 34. The rotation of drive shafts 34, 36 is therefore synchronized with one another and precisely timed relative to the rotation of the main drive shaft 52 of the deburring machine 14.

The tube transfer mechanism 22 forms no part of this invention per se and is thus discussed only briefly herein. As viewed in FIGS. 1–3B, the fixed walking beam 40 of dedimpler head 18 has an upper end formed with four V-shaped notches 60*a*–*d*. Notch 60*b* mounts a tube seat 62 at the dedimpler station 24. The movable walking beam 44 has an upper end which is formed with three V-shaped notches 64*a*–*c* for carrying the tubes 16 to and from the tube seat 62 at the dedimpler station 24.

Figure 2:
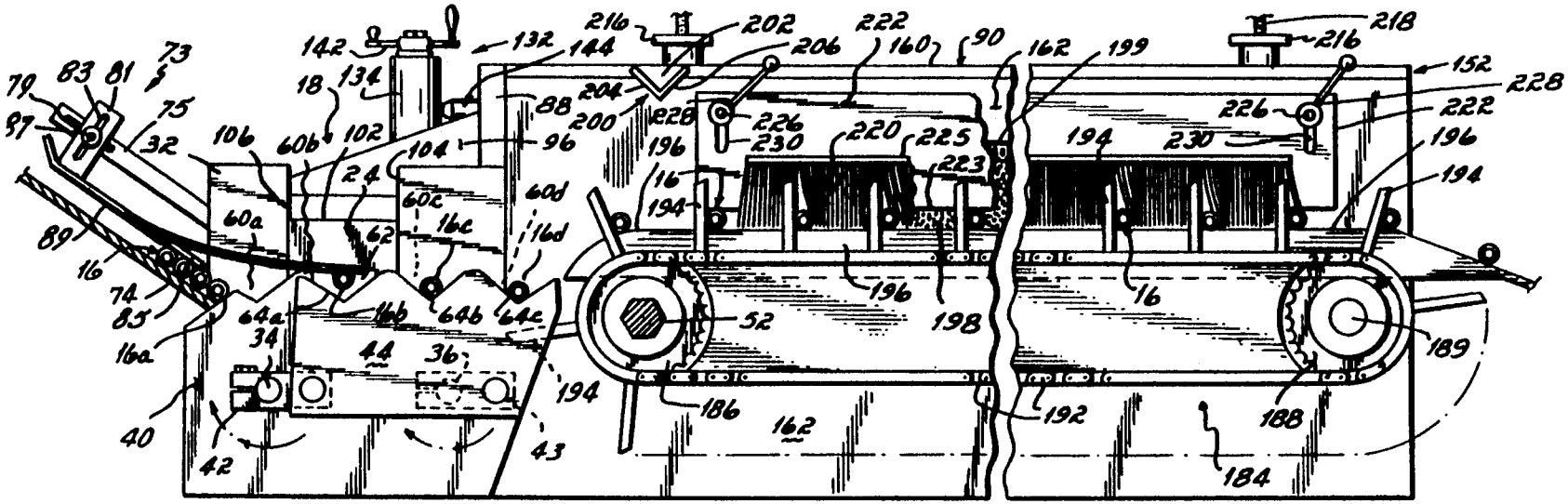
FIG. 2 is a schematic, elevational view, taken along line 2—2 of FIG. 1, of one side of the dedimpler and deburring apparatus which is partially broken away to illustrate a deburring brush.
Figure 3B:
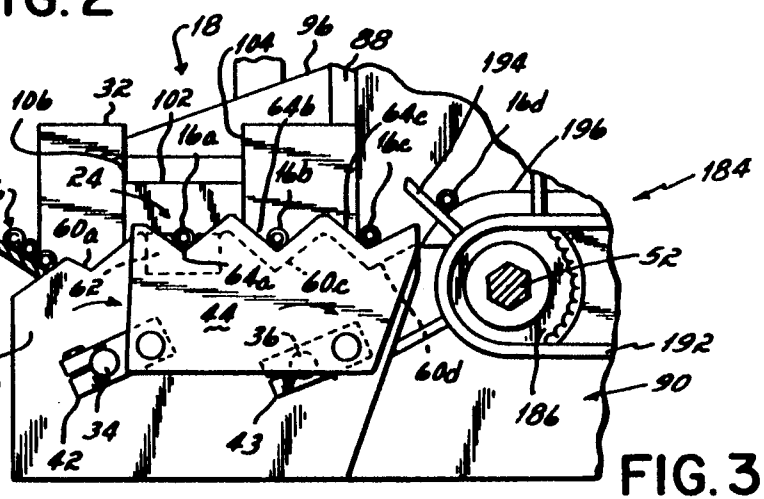
FIG. 3B is a view similar to FIG. 3A except with the tube transfer mechanism in a different position.
Figure 3A:
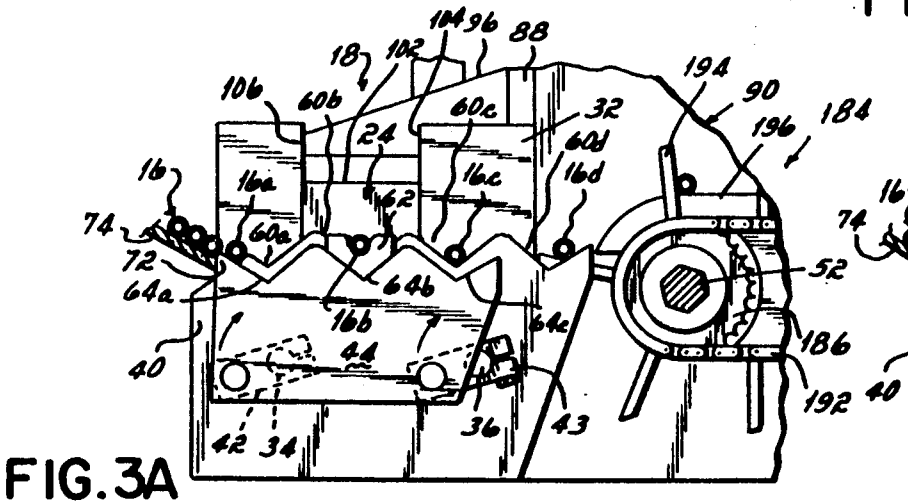
FIG. 3A is a partial, schematic view of one side of the dedimpler machine illustrating one embodiment of a tube transfer mechanism.

As depicted in FIGS. 2, 3A and 3B, in response to rotation of the drive shafts 34, 36, the lever arms 42, 43 rotate to move the movable walking beam 44 along an arcuate path from a tube pick-up position shown in FIG. 3A, to a tube placement position shown in FIG. 3B, and finally to a tube transfer position shown in FIG. 2. In the tube pick-up position, a leading edge 72 of the V-shaped notch 64*a* of movable walking beam 44 engages a tube 16*a* carried on an angled feed plate 74 located at the input end of the dedimpler machine 12. The tube 16*a* rolls to the bottom of the V-shaped notch 64*a* and is then carried in an arcuate, vertically upward path to the dedimpler station 24 immediately above the tube seat 62 mounted in notch 60*b* of the fixed walking beam 40. Having reached this position, the movable walking beam 44 then begins to move downwardly to deposit the tube 16*a* into the tube seat 62 in preparation for the dedimpling operation described below. See FIG. 3B.

In the presently preferred embodiment, structure is provided at both the fixed and movable dedimpler heads 18, 20 to smoothly feed the tubes 16 to the movable walking beam 44 and to help "settle down" or quickly seat the tubes 16 within the tube seat 62 at the dedimpler station 24. As shown in association with the fixed dedimpler head 18, bracket 73 having an angled arm 75 formed with a slot 79 carries a second arm 81 also having a slot 83. The second arm 81 mounts a series of fingers 85 which are angled at the same angle as feed plate 74 and extend immediately above the tubes 16 thereon. The fingers 85 function to retain the tubes 16 side-by-side atop the feed plate 74 so that they are smoothly fed to the movable walking beam 44. A clamp 87 is provided to interconnect the second arm 81 with angled arm 75 so that the position of fingers 85 above the feed plate 74 can be adjusted to accommodate tubes 16 of different diameter. The second arm 81 also carries an elongated spring plate 89 which extends outwardly from the feed plate 74 to the dedimpler station 24. This elongated spring plate 89 engages a tube 16*a* carried by the movable walking beam 44 and urges it downwardly into the tube seat 62 so that the tube 16*a* quickly "settles down" or comes to a fixed, seated position within the tube seat 62 in preparation for the dedimpling operation.

After the movable walking beam 44 picks up a tube 16*a* at the feed plate 74, its V-shaped notches 64*b* and 64*c* pick up tubes 16*b* and 16*c*, respectively, carried by the fixed walking beam 40. As shown in FIG. 3A, tube 16*b* is located in the tube seat 62 at the dimpler station 24, and a tube 16*c* is located in V-shaped notch 60*c* of the fixed walking beam 40. Simultaneously with such motion of the movable walking beam 40, a tube 16*d* resting in the notch 60*d* of fixed walking beam 40 is removed therefrom by a tube conveyor associated with the deburring machine 14, as described in more detail below. When the movable walking beam 44 then reaches its lowermost position and begins to move back upwardly, as sequentially illustrated in FIGS. 3B and 2, the tube 16*a* is placed into the tube seat 62 at the dedimpler station 24, the tube 16*b* is moved to the notch 60*c* of fixed walking beam 40, and the tube 16*c* is placed in the notch 60*d* of the fixed walking beam 40 at the tube transfer position.

The walking beams 40, 44 forming the tube transfer mechanism 22 ensure that the tubes 16 are sequentially advanced from the tube pick-up position at the feed plate 74, to the dedimpler station 24, and then to the tube transfer position for pick-up by the conveyor of the deburring machine 14 in a precisely timed and synchronized manner. Because the drive shafts 34, 36 of the movable dedimpler head 20 are driven by the same main drive shaft 52 as the shafts 34, 36 of the fixed dedimpler head 18, movement of the movable walking beams 44 on each side of the tube transfer mechanism 22 is synchronized and precisely timed. Both ends of the tubes 16 are thus presented at the dedimpler station 24 at precisely the same time for the dedimpling operation, as described below.

Figure 7:
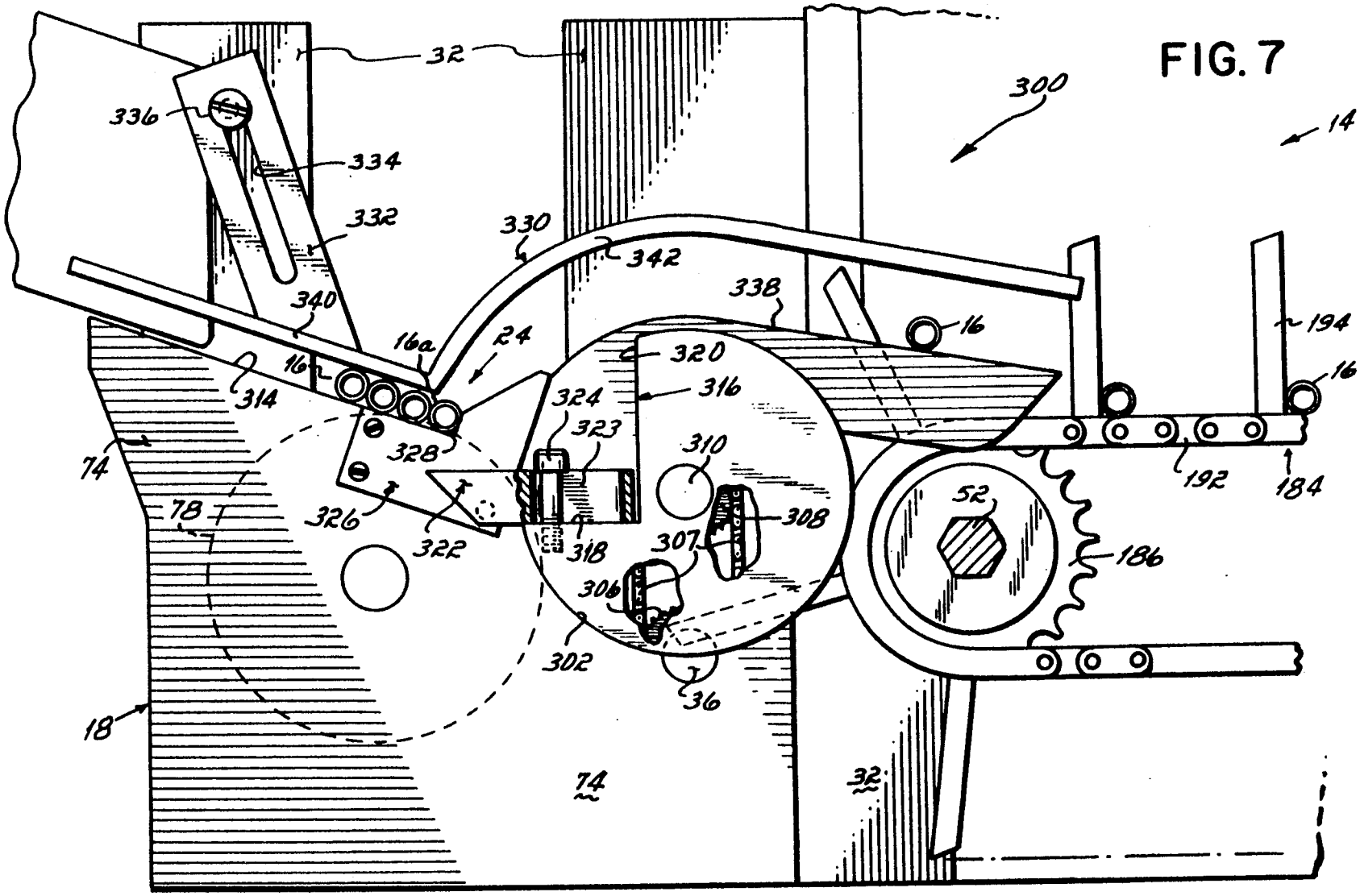
FIG. 7 is a view similar to FIG. 3A, but of an alternative embodiment of a tube transfer device associated with the dedimpler machine.

An alternative embodiment of a tube transfer mechanism 300 is illustrated in FIG. 7, which is adapted for use with the construction of the dedimpler machine 12 described in detail above. In this embodiment, the walking beams 40 and 44 are eliminated and replaced with a rotary index wheel 302 which is effective to transfer tubes from the dedimpler station 24 to the tube transfer position for pick-up by the conveyor of the deburring machine 14. For purposes of the present discussion, only that portion of the tube transfer mechanism 300 associated with dedimpler head 18 is described herein, it being understood that the movable dedimpler head 20 has the identical structure of tube transfer mechanism 300 as dedimpler head 18.

As shown in FIG. 7, the drive shaft 34 employed in the embodiments of FIGS. 1–5 is eliminated and only the drive shaft 36 is required to drive the rotary index wheel 302. Preferably, one end of the drive shaft 36 is carried in bearings (not shown) mounted to the side plates 30, 32 (FIG. 4) of dedimpler head 18. Such end of drive shaft 36 mounts a drive sprocket 306 which is drivingly connected by a chain 307 to a driven sprocket 308 mounted to a stub shaft 310. One end of this stub shaft 310 is carried in a bearing (not shown) mounted to the side plate 32, vertically above the drive shaft 36, and the opposite end of the stub shaft 310 is carried in a bearing (not shown) mounted to the upper portion of feed plate 74. The outer end of stub shaft 310 is fixedly mounted to the rotary index wheel 302 thus forming a drive train from the drive shaft 36, through sprockets 306, 308 and stub shaft 310 to the rotary index wheel 302. In the presently preferred embodiment, the sprockets 306, 308 are sized such that a one-to-one ratio is maintained between the drive shaft 36 and stub shaft 310, i.e., the stub shaft 310 rotates one revolution for each revolution of the drive shaft 36.

The rotary index wheel 302 is a circular plate formed with an L-shaped cut-out portion 316 defining perpendicularly oriented flat surfaces 318 and 320. Preferably, the flat surface 318 mounts a tube pick-up dog 322 formed with an elongated slot 323. The tube pick-up dog 322 is radially inwardly and outwardly adjustable relative to the center of rotary index wheel 302 by loosening a bolt 324 extending through the slot 323 in dog 322 into the wheel 302, and then sliding the dog 322 to the desired position along flat surface 318 after which the bolt 324 is tightened down on the dog 322. As described below, radial adjustment of the dog 322 is necessary to accommodate tubes 16 of varying diameter.

In contrast to the embodiment of FIGS. 1–5, the inlet ramp 314 of feed plate 74 is extended rearwardly to a position immediately adjacent the dedimpler station 24. Preferably, a tube stop 326, formed of nylon or other plastic material, is mounted to the feed plate 74 in position to directly receive tubes 16 at the dedimpling station 24. As viewed in FIG. 7, the tube stop 326 has a V-shaped notch 328 which corresponds in size to the diameter of a tube 16. It is contemplated that tube stops 326 having V-shaped notches 328 of different size will be employed with a tube transfer mechanism 300 of this embodiment depending upon the diameter of the tube 16 to be dedimpled.

A tube guide 330 is mounted by a bracket 332 to the side plate 32. The bracket 332 is formed with an elongated slot 334 which receives a bolt 336 connected to side plate 32 which secures the bracket 332 at various positions along the side plate 32 so that the tube guide 330 can be mounted at varying distances from the feed plate 74 and the tube ramp 338 located downstream from the dedimpling station 24. As shown in FIG. 7, part of the tube guide 330 includes a feed portion 340 which extends substantially parallel to the ramp surface 314 of feed plate 74 and terminates at a location immediately upstream from the dedimpler station 224. The remainder of the tube guide 330 consists of an arcuate, tube retainer portion 342 which extends downstream from the dedimpler station 24 and generally conforms to the shape of the tube ramp 338. The tube retainer portion 342 of tube guide 330 stops short of the conveyor 184 associated with deburring machine 14 which is described in more detail below.

The operation of tube transfer mechanism 300 is as follows. A number of tubes 16 are carried on the ramp surface 314 of feed plate 74 and roll therealong by gravity to the dedimpler station 24. The leading or first tube 16*a* seats within the V-shaped notch 328 of the tube stop 326 at the dedimpler station 324 in preparation for the dedimpling operation described below. The purpose of the rotary index wheel 302 and dog 322 is to remove the leading tube 16*a* from the dedimpler station 24 and tube stop 326 in timed sequence after the dedimpling operation has been completed. This is accomplished by the driving connection between the drive shaft 36 and rotary index wheel 302 via the drive train described above. In response to rotation of drive shaft 36, which controls the dedimpling operation described below, the rotary index wheel 302 is rotated so that the dog 322 mounted thereto engages and removes a leading tube 16*a* from the tube stop 326 at dedimpling station 24. The rotary index wheel 302 and dog 322 throw the tube 16*a* upwardly and rearwardly or downstream from the dedimpler station 24 onto the tube ramp 338. As viewed in FIG. 7, the tube ramp 338 is contoured to allow the tube 16 to roll by gravity therealong to the tube transfer position for pick up by the conveyor 184 of the deburring machine 14.

The tube guide 330 is needed to help control the movement of the tubes 16, both along the feed plate 74 and tube ramp 338. The feed portion 340 of tube guide 330, located immediately above and parallel to the ramp 314 of feed plate 74, ensures that the tubes 16 serially move to the tube stop 326 at the dedimpler station 24 without bunching up or moving atop one another. The bracket 332 permits adjustment of the spacing of the feed portion 340 of tube guide 330 above the top surface 314 of feed plate 74 to accommodate tubes 16 of different diameter and to prevent bunching up of the tubes. The tube retainer portion 342 of tube guide 330 assists in retaining and guiding the tubes 16 onto the tube ramp 338 after pick up from the tube stop 326 by the rotary index wheel 302 and dog 322. It has been found, particularly at high operating speeds, that the tubes 16 tend to be thrown upwardly and rearwardly from the tube stop 326 with sufficient force to sometimes prevent the tubes 16 from smoothly rolling along tube ramp 338. The tube retainer portion 342 of tube guide 330 "catches" the tubes 16 and ensures that they are serially deposited onto the tube ramp 338 and smoothly moved therealong by gravity to the tube transfer position for further processing as described below.

Referring now to FIGS. 1 and 4, the structure associated with the dedimpler machine 12 which performs the dedimpling operation is illustrated. Generally, this structure functions to move a dedimpler plug 76 located at the dedimpler station 24 between an extended position wherein the dedimpler plug 76 enters the interior of the cut end of a tube 16, and a retracted position wherein the dedimpler plug 76 disengages the tube 16. In the extended position, as viewed in FIG. 4, the conical-shaped end 77 of the dedimpler plug 76 is located immediately above a presser roller 78 which is mounted for free-wheeling rotation on the side plate 32. The dedimpler plug 76 is rotated with respect to the tube 16, as described below, so as to force the wall at the cut end of a tube 16 against the presser roller 78 and flatten constrictions or dimples formed therein. An important aspect of this invention is that movement of the dedimpler plug 76 between the extended and retracted positions, in both the fixed and movable dedimpler heads 18, 20, is precisely timed and synchronized with the movement of the tube 16 to the dedimpler station 24.

As shown in FIGS. 4 and 5, a vertically extending, backing plate 80 is carried at opposite edges in ways 82, 84 formed in blocks 86, 88, respectively. The blocks 86, 88 are mounted to the frame of a fixed brush head 90 associated with the deburring machine 14 as discussed in detail below. The deburring machine 14 also includes a movable brush head 92 having a frame which mounts the backing plate 80 of the movable dedimpler head 20 in the identical manner as described below in connection with the fixed dedimpler head 18. The backing plate 80 is fixedly mounted to a pair of flanges 94, 96 which, in turn, are welded or brazed to a horizontal plate 98. One edge of the horizontal plate 98 fixedly mounts a side plate 100, such as by welding or brazing, and the opposite edge of the horizontal plate 98 is welded or brazed to a second side plate 102. This second side plate 102 is vertically movable along the side edges 104 and 106 of an opening formed in the side plate 32 of the base 26 of dedimpler head 18.

The underside of the horizontal plate 98 fixedly mounts a shaft support bearing 108 which rotatably carries a shaft 110 having a chuck 112 at one end which mounts the dedimpler plug 76. The opposite end of shaft 110 extends through the side plate 100 into a gear box 114 fixed to the side plate 100. The gear box 114, in turn, supports a motor 116. The motor 116 drives the gear box 114 which forms a splined connection 118 with the end of shaft 110 to rotate the shaft 110 and the dedimpler plug 76, while permitting lateral movement of the shaft 110 relative thereto, for purposes to become apparent below.

As mentioned above, an important aspect of this invention is that the dedimpler plug 76 is moved between an extended and retracted position in precisely timed relation to the movement of the tubes 16 to the dedimpler station 24. This is achieved in this invention by the cam arrangement depicted in FIG. 4. A barrel cam 120 formed with a cam groove 122 is fixedly mounted upon the drive shaft 36 which assists in driving the movable walking beam 44 of the tube transfer mechanism 22, or the rotary index wheel 302 of the tube transfer mechanism 300, as described above. A carriage 124 is fixed to the shaft 110 carrying the dedimpler plug 76, and this carriage 126 is formed with an extension 126 which mounts a cam follower 128 in position within the cam groove 122 of the barrel cam 120. The uppermost end of the carriage 124 mounts rollers 130 in a position to ride along the bottom surface of the horizontal plate 98.

The dedimpler plug 76 is moved between the extended and retracted position as follows. In response to rotation of the drive shaft 36 and, hence, rotation of the barrel cam 120, the carriage 124, shaft 110 and dedimpler plug 76 are all moved laterally back-and-forth with respect to the cut end of a tube 16 located at the dedimpler station 24. The cam follower 128 moves within the cam groove 122 with the rotation of barrel cam 120, and such movement drives the carriage 124, shaft 110 and dedimpler plug 76 axially toward and away from the tube 16. Because there is a splined connection 118 between the shaft 110 and gear box 114, axial movement of the shaft 110 relative to the gear box 114 is permitted while the shaft 110 remains drivingly connected to the gear box 114.

The barrel cam 120 and cam follower 128 arrangement of this invention provides an accurate, precisely timed movement of the shaft 110 and dedimpler plug 76 between the extended and retracted positions. Because the barrel cam 120 is rotated by the same shaft 36 which drives the movable walking beam 44 of the tube transfer mechanism 22, or rotary index wheel 302 of the tube transfer mechanism 300, the dedimpler plug 76 is actuated in accurately timed relation to the movement of tubes to the dedimpler station 24 by the tube transfer mechanisms 22 or 300. Additionally, since the drive shafts 34, 36 of both the fixed and movable dedimpler heads 18, 20 are drivingly connected to the same, main drive shaft 52, movement of the dedimpler plug 76 associated with the fixed dedimpler head 18 is accurately synchronized with movement of the dedimpler plug 76 associated with the movable dedimpler head 20.

In another aspect of the dedimpler machine 12 of this invention, each of the dedimpler heads 18, 20 includes structure to adjust the vertical position of the dedimpler plug 76 with respect to the presser roller 78 to accommodate tubes having different diameters and different wall thicknesses or gauge. As shown in FIG. 4, a dedimpler plug height adjustment mechanism 132 is provided which includes a tubular housing 134 having a lower end extending through the horizontal plate 98 and fixedly mounted thereto. The tubular housing 134 mounts a rod 136 having a lower, threaded end 138 which mates with internal threads formed in the top portion 139 of a bracket 140 having a lower plate 141 fixed to the base plate 28. This plate 141 mounts a bearing 143 which carries the drive shaft 36. The rod 136 is rotated within the tubular housing 134 by a handle 142 located at its upper end. Preferably, the plug 76 is held in position by a locking device 144 having a handle 145 threaded onto a stud 147 which extends through a slot 146 formed in the backing plate 80. The stud 147 is fixed to the frame of the fixed brush head 90 of the deburring machine 14.

Adjustment of the vertical position of the dedimpler plug 76 with respect to the presser roller 78 and the tube seat 62 or tube stop 326 is accomplished as follows. Initially, the locking device 144 is loosened so as to permit vertical movement of the backing plate 80 relative to the frame of the fixed brush head 90 of deburring machine 14. As mentioned above, the backing plate 80 is fixedly mounted to the horizontal plate 98 which, in turn, carries the first and second side plates 100, 102. The horizontal plate 98 also carries the shaft support bearing 108 which pivotally mounts the shaft 110. The shaft 110 mounts the dedimpler plug 76 and carriage 124. Accordingly, the entire upper portion of the dedimpler machine 12 is vertically movable as a unit.

After loosening the locking device 144, the handle 142 of height adjustment mechanism 132 is rotated, which, in turn, rotates the rod 136 with respect to the fixed bracket 140. The backing plate 80 slides vertically along the ways 82, 84 of blocks 86, 88, and the second side plate 102 slides vertically along the edges 104, 106 of the fixed side plate 32 of the dedimpler base 26. Because of the connection between the backing plate 80, horizontal plate 98, shaft support bearing 108 and shaft 110, the dedimpler plug 76 moves vertically with the movement of backing plate 80. As a result, the dedimpler plug 76 can be moved to the desired vertical position with respect to the presser roller 78 forming a space therebetween to accommodate tubes of different diameter and different gauge or wall thickness. When the desired vertical position of the dedimpler plug 76 has been obtained, the locking device 144 is returned to its locked position to secure the entire movable upper unit of the dedimpler machine 12 in place.

Deburring Machine

Referring now to FIGS. 1, 2, 5 and 6, the deburring machine 14 of this invention is illustrated in detail.

As mentioned above, the deburring machine 14 includes a fixed brush head 90 and a movable brush head 92. The brush heads 90, 92 are mounted upon a pair of support rails 148, 150, and the movable brush head 92 is laterally adjustable along the supports 148, 150 to vary the space between the brush heads 90, 92 and thus accommodate tubes 16 of different lengths, as discussed below. The structure for positioning the movable brush head 92 along the supports 148, 150 forms no part of this invention per se, and is thus not discussed herein. For purposes of the present description, the fixed brush head 90 is illustrated and discussed in detail, it being understood that the structure and operation of the movable brush head 92 is identical.

The fixed brush head 90 comprises a frame 152 having a bottom wall 154 resting atop the supports 148, 150, opposed side walls 156, 158, a top wall 160, a front wall 162 and a relatively thin, sheet metal back wall 164. As discussed above, the frame 152 of fixed brush head 90 mounts the blocks 86, 88 which support the vertical plate 80 of the dedimpler machine 12.

Figure 6:
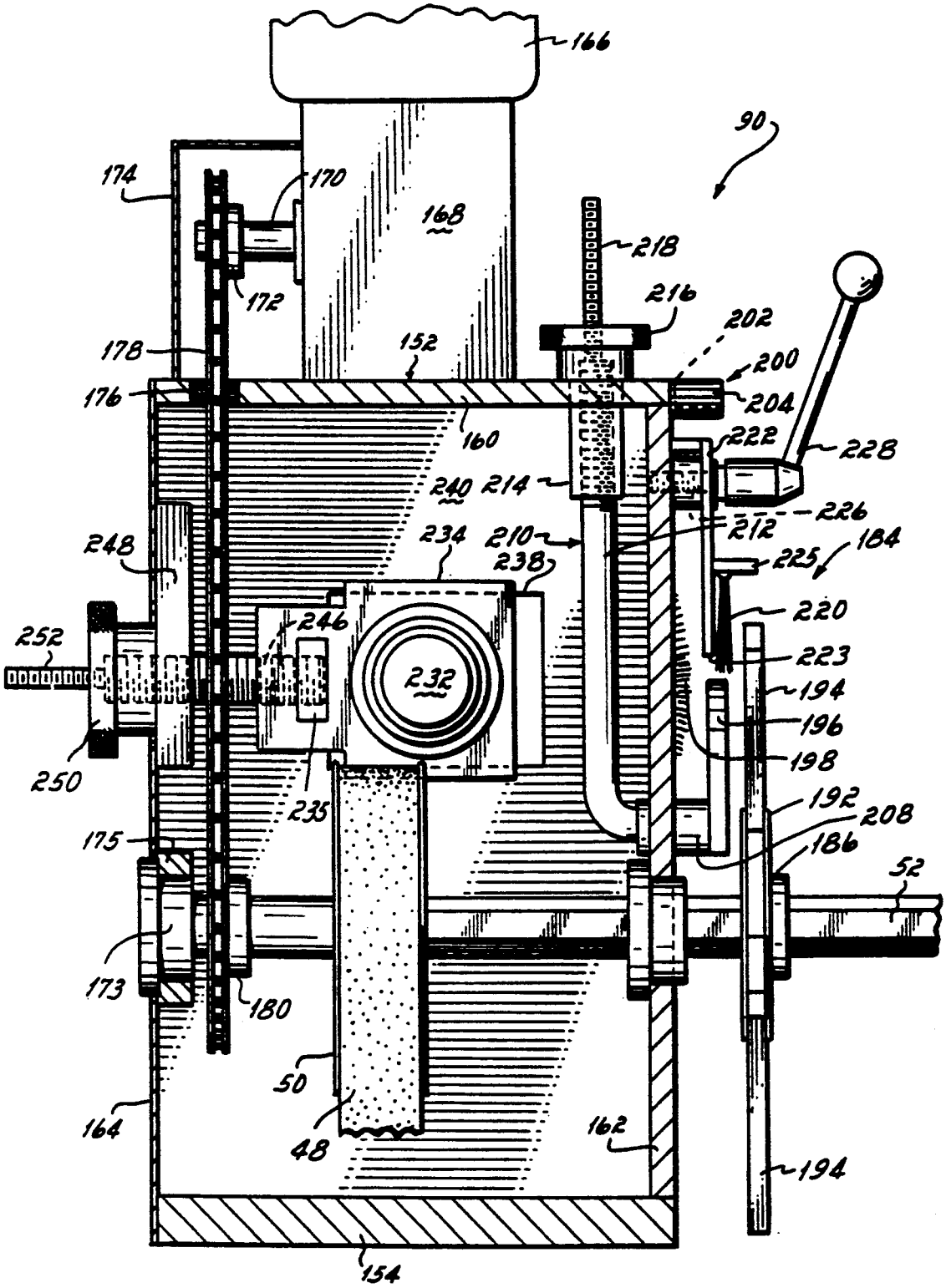
FIG. 6 is a cross sectional view taken generally along line 6—6 of FIG. 1.

With reference to FIGS. 5 and 6, the main drive shaft 52 of the deburring machine 14, mentioned above, powers much of the operation of the combined dedimpler and deburring apparatus 10. Preferably, the top wall 160 of frame 152 mounts a DC motor 166 connected to a gear box 168 whose output shaft 170 drives a sprocket 172. These elements are protected by a cowling 174 as shown in FIG. 5 An opening 176 is formed in the top wall 160 through which a drive chain 178 extends. This drive chain 178 is connected between the drive sprocket 172 on output shaft 170, and a driven sprocket 180 fixed to the hex-shaped main drive shaft 52 of the deburring machine 14. As shown in FIG. 6, the inner end of drive shaft 52 is mounted in a bearing 173 carried by a plate 175 extending from the side wall 156 of frame 152. The side wall 156 of frame 152 is formed with an opening 182 for the timing belt 48 which extends between the timing pulley 50 on the main drive shaft 52 and the timing pulley 46 on the tube transfer mechanism drive shaft 36, as discussed above. As viewed in FIG. 1, the main drive shaft 52 is elongated and extends from the fixed brush head 90 to the movable brush head 92 and then along the support 150 to permit adjustment of the lateral position of the movable brush head 92 relative to the fixed brush head 90 without disengaging the movable brush head 92.

The main drive shaft 52 provides power for the tube conveyor 184 of the deburring machine 14, located between the brush heads 90, 92, which conveys tubes 16 from the tube transfer position at the discharge end of the dedimpler machine 12 through the deburring machine 14. As shown in FIGS. 2 and 6, the main drive shaft 52 mounts a conveyor drive sprocket 186 located at the inlet end of the deburring machine 14 near the dedimpler machine 12, and a follower sprocket 188 is rotatably mounted on a shaft 189 at the opposite or outlet end of the brush head 90. An endless chain 192 extends between the sprockets 186, 188 which carries longitudinally spaced pins or dogs 194. The dogs 194 and chain 192 move along a run which is adjacent a side rail 196 adjustably mounted to the brush head 90 in a manner discussed below. The identical structure described above is incorporated in the movable brush head 92 to form the complete tube conveyor 184 as viewed in FIG. 1.

An important function of the tube conveyor 184 is to properly locate the cut ends of tubes 16 with respect to a deburring brush 198 carried in each of the deburring machine 14. The tube ends must be conveyed past the deburring brushes 198 in a position to permit contact of the brushes 198 with the tube ends to remove burrs, but without damaging the tubes 16 or the brushes 198. Adjustment structure is provided in the deburring machine 14 to properly orient the tubes 16 both vertically and laterally relative to the deburring brushes 198 to accommodate tubes of different diameter and length, and to ensure that the tube ends are accurately positioned on both sides of the tube conveyor 184.

With reference to FIGS. 1 and 2, adjustment structure is illustrated for obtaining the appropriate lateral space between the brush heads 90, 92 for a tube 16 of given length. Each brush head 90, 92 mounts a V-shaped tube holder 200 on the front wall 162 thereof, which are adapted to receive opposite ends of a tube 16. These V-shaped tube holders 200 include a back wall 202, mounted against the front wall 162 of frame 152, and a pair of angled side walls 204, 206. In order to obtain the proper lateral position of the brush heads 90, 92, a tube 16 of given length is first inserted into the tube holder 200 of the fixed brush head 90. The movable brush head 92 is then moved along the supports 148, 150 until the opposite end of the tube 16 can rest within the tube holder 200 mounted to the movable brush head 92. When the opposed end edges of the tube 16 each rest against the back wall 202 of the tube holder 200 on both the fixed brush head 90 and movable brush head 92, the appropriate spacing between the brush heads 90, 92, i.e., the width of tube conveyor 184, is obtained for a tube 16 of such length. With the brush heads 90, 92 in such position, a mechanism (not shown) is activated to fix the movable brush head 92 in position along the supports 148, 150 so that the deburring operation can proceed. Because the movable dedimpler head 20 is fixed to the movable brush head 92 through the connection of vertical plate 80 and blocks 86, 88, described above, the movable dedimpler head 20 is automatically adjusted to the appropriate position relative to fixed dedimpler head 18 with the adjustment of the movable brush head 92.

Each brush head 90, 92 also includes structure for adjusting the vertical position of tubes moving along the rails 196 of tube conveyor 184 relative to the deburring brushes 198. As viewed in FIGS. 2 and 6, the dogs 194 carried by the chains 192 move in a clockwise direction between the sprockets 186, 188. In the course of movement around the drive sprocket 186, each dog 194 engages the tube 16*d* resting within the notch 60*d* of the fixed walking beam 40 and transfers such tube 16 onto the top surface of the side rails 196. The tubes 16*d* are carried atop the side rails 196 along the length of the brush heads 90, 92 and are advanced therealong by the dogs 194. In order to adjust the vertical position of the tubes 16*d* relative to the deburring brushes 198, the vertical position of the side rails 196 must be adjusted accordingly.

As shown in FIGS. 2 and 6, each side rail 196 is connected at each end to the lower leg 208 of an L-shaped adjustor rod 210 which has a vertical leg 212 extending upwardly to the top wall 160 of the brush head frame 152. The upper end of vertical leg 212 is threaded and received within an internally threaded sleeve 214 carried by the top wall 160. The threaded portion of the vertical leg 212 extends upwardly from sleeve 214, through the top wall 160, and is threadedly engaged by an adjustment knob 216. A scale 218 is mounted to the top end of the vertical leg 212 which extends through the adjustment knob 216 so that the measuring increments on the scale 218 are readily visible above the top surface of the adjustment knob 216.

In response to rotation of each adjustment knob 216, two adjustment rods 210, one at each end of the side rail 196, are moved vertically upwardly and downwardly carrying with them the side rail 196. The scale 218 allows the operator to obtain an accurate indication of the vertical position of side rails 196 so that the opposed cut ends of the tubes 16 moving along the tube conveyor 184 are properly located relative to the deburring brushes 198, and so that the side rails 196 on both brush heads 90, 92 are at the same height relative to one another.

In the presently preferred embodiment, adjustment of the vertical position of side rails 196 is accompanied by a corresponding adjustment of the vertical position of a tube rotating brush 220 carried by each brush head 90, 92 which extends along substantially the entire length thereof. As viewed in FIGS. 2 and 6, a plate 222 having a lower edge 223 mounts a shelf 225 which carries the tube rotating brush 220 in a position such that the lowermost end of the brush 220 is located immediately above the side rail 196. The brush 220 contacts the tubes 16 as they move along the side rails 196 to rotate the tubes 196 and to maintain them in contact with the adjacent dogs 194 on the chain 192 of tube conveyor 184, and to maintain them in position beneath the lower edge 223 of plate 222. Rotation of the tubes 16 assists in the deburring operation performed by the deburring brushes 198.

In order to maintain the tube rotating brushes 220 in position immediately above the side rails 196 when the side rails 196 are vertically adjusted as described above, the plate 222 and shelf 225 which supports the rotating brushes 220 are vertically movable along the front wall 162 of the frame 152. A pair of locking screws 226 having handles 228 are each carried within a slot 230 formed at opposite ends of the plate 222, and these locking screws 226 extend into the front wall 162 of frame 152. The locking screws 226 are loosened in order to permit movement of the plate 222 and tube rotating brushes 220 vertically, and then tightened down against the plate 222 when the desired vertical position of the brushes 220 has been obtained.

Another important aspect of this invention is the provision of structure to permit lateral adjustment of the deburring brushes 198 within each brush head 90 and 92 relative to the tube conveyor 184. Such lateral adjustment is desirable because the deburring brushes 198 become worn during use and must periodically be repositioned relative to the cut ends of the tubes moving along tube conveyor 184 so that the deburring brushes 198 contact the tube ends to a sufficient degree to perform the deburring operation.

With reference to FIGS. 1, 5 and 6, each deburring brush 198 is fixedly mounted to a shaft 232 in a position immediately adjacent the side rails 196 such that the circumferential periphery of the deburring brush 198 extends at least partially through an opening 199 formed in front wall 162. One end of the shaft 232 is carried in a take-up bearing 234 slidably mounted within a way or slot 238 formed in an internal walls 240, and the opposite end of shaft 232 is mounted to a take-up bearing 236 slidably mounted in a way or slot 239 formed in an internal wall 242. Such opposite end of shaft 232 mounts a sprocket 241 connected by a belt 243 to a drive sprocket 245 carried within a cover 249 on the output shaft 247 of a motor 249 mounted atop the frame 152. The motor 251 operates to rotate the shaft 232 and brush 198 via the drive train formed by sprockets 241, 245 and belt 243. Each take-up bearing 234, 236 mounts a nut 234 which mates with a threaded, adjustment rod 246. The adjustment rod 246 extends through a mounting plate 248 located at the back wall 164 of the brush head frame 152, and is connected thereat to an adjustment knob 250. A scale 252 is connected to the outermost end of the adjustment rod 254 and extends through the adjustment knob 250 such that the measurement increments on the scale 252 are readily visible.

In order to adjust the lateral position of the deburring brushes 198 relative to tubes 16 carried on the side rails 196, the adjustment knob 250 associated with each take-up bearing 234, 236 rotates the threaded, adjustment rod 246. The take-up bearings 234, 236 are thus moved along the slots 238, 239 formed in the internal walls 240, 242, respectively, to position the circumferential periphery of the deburring brush 198 at the desired location through the opening 199 in wall 162. The scale 252 associated with each adjustment knob 250 ensures that both take-up bearings 234, 236 are adjusted to the desired lateral position, and that both ends of the shaft 232 are at the same position relative to one another.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, while a pair of sprockets 306, 308 and a chain 307 are illustrated in FIG. 7 as forming a portion of the drive train of that embodiment, it is contemplated that the sprockets 306, 308 could be replaced with intermeshing gears particularly when the dedimpler apparatus is employed as a stand-alone unit.

Therefore, it is intended that the invention not be limited to the particular embodiment disclosed as the best mode contemplated for carrying out this invention, but that the invention will include all embodiments falling within the scope of the appended claims.

We claim:

1. Apparatus for removing dimples from the wall of tubes at a cut end thereof, comprising:

tube support means for receiving tubes at a dedimpler station;

feed means for serially feeding tubes to said tube support means;

a presser roller located at said dedimpler station in a position to contact the outer surface of the tube wall at the cut end of the tube;

a dedimpler plug located at said dedimpler station, said dedimpler plug being movable between an extended position in which one end of said dedimpler plug extends into the cut end of the tube and contacts the inner surface of the tube wall held by said tube support means, and a retracted position in which said dedimpler plug is removed from the end of the tube, said dedimpler plug being effective in said extended position to press the tube wall at the cut end of the tube against said presser roller to substantially remove dimples thereat;

first drive means for moving said dedimpler plug between said extended position and said retracted position;

take-away means for removing a tube from said dedimpler station;

second drive means, which mechanically interconnects said first drive means with said take-away means, for rotating said take-away means with respect to said dedimpler station in timed sequence with the movement of said dedimpler plug so that said take-away means removes a tube from said dedimpler station upon retraction of said dedimpler plug from the cut end of the tube.

2. The apparatus of claim 1 in which said tube support means is a tube stop having a V-shaped notch, said feed means for serially feeding tubes comprising a feed plate having a top surface oriented at an inclined angle relative to horizontal, said feed plate having a discharge end located relative to said support block so that tubes are serially fed by gravity directly into said V-shaped notch of said tube stop.

3. The apparatus of claim in which said take-away means comprises:

a plate located at said dedimpler station, said plate being rotatably connected to said second drive means;

a tube pick-up dog mounted to said plate;

adjustment means for adjusting the position of said tube pick-up dog on said plate relative to said tube support means.

4. The apparatus of claim 3 in which said first drive means comprises:

a rotating drive shaft;

a cam carried by said drive shaft, said cam being formed with a cam groove;

a movable carriage connected to said dedimpler plug, said carriage having a cam follower carried within said cam groove in said cam so that said dedimpler plug is moved between said extended and retracted positions as said cam follower moves along said cam groove.

5. The apparatus of claim 4 in which said second drive means comprises means for drivingly interconnecting said drive shaft and said plate so that rotation of said drive shaft causes said plate to rotate in timed sequence with the movement of said dedimpler plug between said extended and retracted positions.

6. The apparatus of claim 3 in which said plate is formed with a cut-out portion forming a mounting surface which supports said tube pick-up dog, said adjustment means comprising an elongated slot formed in said tube pick-up dog and a bolt insertable through said slot in said tube pick-up dog and into said plate.

7. Apparatus for removing dimples from the wall of tubes at a cut end thereof, comprising:

tube support means for receiving tubes at a dedimpler station;

feed means for serially feeding tubes to said tube support means;

a presser roller located at said dedimpler station in a position to contact the outer surface of the tube wall at the cut end of the tube;

a dedimpler plug located at said dedimpler station, said dedimpler plug being movable between an extended position in which one end of said dedimpler plug extends into the cut end of the tube and contacts the inner surface of the tube wall held by said tube support means, and a retracted position in which said dedimpler plug is removed from the end of the tube, said dedimpler plug being effective in said extended position to press the tube wall at the cut end of the tube against said presser roller to substantially remove dimples thereat;

first drive means for moving said dedimpler plug between said extended position and said retracted position;

take-away means for removing a tube from said dedimpler station;

second drive means, which mechanically interconnects said first drive means with said take-away means, for rotating said take-way means with respect to said dedimpler station in timed sequence with the movement of said dedimpler plug so that said take-away means removes a tube from said dedimpler station upon retraction of said dedimpler plug from the cut end of the tube;

guide means for guiding tubes along said feed means to said dedimpler station, and for guiding tubes removed from said dedimpler station.

8. The apparatus of claim 7 in which said feed means includes a feed plate having a top surface oriented at an inclined angle relative to horizontal, said guide means comprising:

a first plate spaced from and oriented substantially parallel to said top surface of said feed plate to ensure that the tubes move side-by-side along said feed plate;

a tube ramp located downstream from said dedimpler station;

a second plate located vertically above said tube support means and said tube ramp in a position to engage tubes removed from said tube support means by said take-away means and to direct such tubes onto said tube ramp.

9. The apparatus of claim 8 in which said guide means includes adjustment means for adjusting the position of at least one of said first plate relative to said top surface of said feed plate, and said second plate relative to said tube support means and said tube ramp.

10. The apparatus of claim 9 in which said first plate and said second plate are interconnected, said adjustment means being effective to simultaneously adjust the position of said first and second plates to accommodate tubes of different diameter.

11. A combined dedimpling and deburring apparatus, comprising:

a pair of laterally spaced dedimpler heads;

tube support means associated with each of said dedimpler heads for receiving tubes at a dedimpler station;

feed mans for serially feeding tubes to said tube support means;

a presser roller carried by each of said dedimpler heads at said dedimpler station in a position to contact the outer surface of the tube wall at one end of the tube;

a dedimpler plug carried by each of said dedimpler heads at said dedimpler station, each of said dedimpler plugs being movable between an extended position in which each dedimpler plug extends into one end of the tube and contacts the inner surface of the tube wall thereat, and a retracted position in which each of said dedimpler plugs is removed from an end of the tube, said dedimpler plugs being effective in said extended position to press the tube wall at the ends of the tube against said pressure rollers to substantially remove dimples thereat;

dedimpler drive means associated with each of said dedimpler heads for moving said dedimpler plugs between said extended and retracted positions;

take-away means associated with each of said dedimpler heads for removing tubes from said dedimpler station, and for directing said tubes removed from said dedimpler station to a tube transfer station;

second drive means associated with each of said dedimpler heads and mechanically interconnecting each of said dedimpler drive means with one of said take-away means for rotating said take-away means relative to said dedimpler station in timed sequence with the movement of said dedimpler plugs so that said take-away means remove a tube from said dedimpler station upon retraction of said dedimpler plugs from the cut ends of the tube;

a pair of laterally spaced brush heads;

conveyor means for picking up tubes at said tube transfer station and conveying the tubes between said brush heads so that each end of the tubes moves past one of said brush heads;

brush means associated with each of said brush heads for removing burrs from an end of the tubes moving therepast;

deburring drive means for driving said dedimpler drive means and for driving said conveyor means in timed sequence with one another so that the tubes are moved to said dedimpler station in sequence with the movement of said dedimpler plugs between said extended and retracted position and so that the tubes are moved from said dedimpler station to said tube transfer station in sequence with the movement of said conveyor means.

12. The apparatus of claim 11 in which said tube support means is a tube stop having a V-shaped notch, said feed means for serially feeding tubes comprising a feed plate having a top surface oriented at an inclined angle relative to horizontal, said feed plate having a discharge end located relative to said support block so that tubes are serially fed by gravity directly into said V-shaped notch of said tube stop.

13. The apparatus of claim 11 in which said take-away means comprises:

a plate located at said dedimpler station, said plate being rotatably connected to said second drive means;

a tube pick-up dog mounted to said plate;

adjustment means for adjusting the position of said tube pick-up dog on said plate relative to said tube support means.

14. The apparatus of claim 13 in which said drive means comprises:

a rotating drive shaft;

a cam carried by said drive shaft, said cam being formed with a cam groove;

a movable carriage connected to said dedimpler plug, said carriage having a cam follower carried within said cam groove in said cam so that said dedimpler plug is moved between said extended and retracted positions as said cam follower moves along said cam groove.

15. The apparatus of claim 14 in which said second drive means comprises means for drivingly interconnecting said drive shaft and said plate so that rotation of said drive shaft causes said plate to rotate in timed sequence with the movement of said dedimpler plug between said extended and retracted positions.

16. The apparatus of claim 13 in which said plate is formed with a cut-out portion forming a mounting surface which supports said tube pick-up dog, said adjustment means comprising an elongated slot formed in said tube pick-up dog and a bolt insertable through said slot in said tube pick-up dog and into said plate.

17. The apparatus of claim 11 in which each of said dedimpler heads includes guide means for guiding tubes along said feed means to said dedimpler station, and for guiding tubes removed from said dedimpler station.

18. The apparatus of claim 17 in which said feed means includes a feed plate having a top surface oriented at an inclined angle relative to horizontal, said guide means comprising:

a first plate spaced from and oriented substantially parallel to said top surface of said feed plate to ensure that the tubes move side-by-side along said feed plate;

a tube ramp located downstream from said dedimpler station;

a second plate located vertically above said tube support means and said tube ramp in a position to engage tubes removed from said tube support means by said take-away means and to direct such tubes onto said tube ramp.

19. The apparatus of claim 18 in which said guide means includes adjustment means for adjusting the position of at least one of said first plate relative to said top surface of said feed plate, and said second plate relative to said tube support means and said tube ramp.

20. The apparatus of claim 19 in which said first plate and said second plate are interconnected, said adjustment means being effective to simultaneously adjust the position of said first and second plates to accommodate tubes of different diameter.

* * * * *